United States Patent [19]

Ford

[11] Patent Number: 5,042,820

[45] Date of Patent: Aug. 27, 1991

[54] SOCCERBALL RETURNER

[76] Inventor: James M. Ford, 214 Routh Ct., Schaumburg, Ill. 60193

[21] Appl. No.: 54,238

[22] Filed: May 26, 1987

[51] Int. Cl.[5] ..... A63B 63/02

[52] U.S. Cl. ..... 273/395

[58] Field of Search ..... 273/395, 396, 411, 398–402, 273/182 R, 179 A, 179 B, 127 B, 127 C, 26 A, 127 R; 135/112

[56] References Cited

U.S. PATENT DOCUMENTS

| | | | |
|---|---|---|---|
| 1,567,384 | 12/1925 | Rectenwald et al. | 273/26 A |
| 1,745,201 | 1/1930 | Alston | 273/182 A |
| 2,311,841 | 2/1943 | Lange | 135/112 X |
| 2,313,409 | 3/1943 | Walker | 124/17 |
| 2,443,759 | 6/1948 | Anderson | 273/179 A |
| 2,449,708 | 9/1948 | Lindsay | 273/127 B |
| 2,473,076 | 6/1949 | Scheibner | 135/112 X |
| 2,525,304 | 10/1950 | Lindsay | 273/127 B |
| 2,657,058 | 10/1953 | Mulcahy | 273/395 X |
| 2,827,297 | 3/1958 | Foster | 273/401 |
| 2,908,503 | 10/1959 | Austin et al. | 273/179 A |
| 3,003,769 | 10/1961 | Brandell | 273/179 A |
| 3,194,556 | 7/1965 | Vinson | 273/395 X |
| 3,230,962 | 1/1966 | Hoiness et al. | 135/112 X |
| 3,446,504 | 5/1969 | Pascucci | 273/1.5 A |
| 3,471,150 | 10/1969 | Kaerwer | 273/1.5 A |
| 3,642,282 | 2/1972 | Frischman | 273/127 B |
| 3,752,476 | 8/1973 | Mahoney | 273/26 A X |
| 3,918,711 | 11/1975 | Zak | 273/29 A |
| 3,948,512 | 4/1976 | Worthington | 273/29 A |
| 4,083,561 | 4/1978 | Daffer, Jr. | 273/127 C X |
| 4,108,432 | 8/1978 | Clark et al. | 273/29 A |
| 4,112,911 | 9/1978 | Petrick, Sr. | 124/56 |
| 4,184,503 | 1/1980 | Nakajima | 135/74 X |
| 4,203,413 | 5/1980 | Hodges | 273/29 A X |
| 4,206,916 | 6/1980 | Epply | 273/26 A |
| 4,210,326 | 7/1980 | Booth et al. | 273/127 R X |
| 4,256,303 | 3/1981 | Dobbins | 273/29 A |
| 4,286,786 | 9/1981 | Papadopoulos | 273/396 |
| 4,336,939 | 6/1982 | Krumlauf | 273/182 R X |
| 4,420,158 | 12/1983 | Klock et al. | 273/400 |
| 4,579,340 | 4/1986 | Jenkins et al. | 273/395 X |
| 4,615,528 | 10/1986 | York | 273/396 |
| 4,630,627 | 12/1986 | Windows et al. | 135/112 |
| 4,699,386 | 10/1987 | Carzino | 273/411 X |

FOREIGN PATENT DOCUMENTS

| | | | |
|---|---|---|---|
| 907079 | 8/1972 | Canada | 273/127 B |
| 2847701 | 5/1980 | Fed. Rep. of Germany | 273/400 |
| 3246708 | 4/1984 | Fed. Rep. of Germany | 273/400 |
| 1139181 | 6/1957 | France | 135/112 |
| 2551982 | 3/1985 | France | 273/400 |
| 2129310 | 5/1984 | United Kingdom | 273/182 R |

*Primary Examiner*—Paul E. Shapiro

*Attorney, Agent, or Firm*—Hill, Van Santen, Steadman & Simpson

[57] ABSTRACT

A soccerball returner is provided which has a goal portion comprising a ball capturing box-like member with an open front side and a bottom wall which directs a captured ball toward a ball return mechanism. The ball return mechanism includes a ball engaging element, which may be in the form of a motor driven crank arm or a spring loaded solenoid, to impart sufficient momentum to the ball to cause it to be driven away from the soccerball returner.

16 Claims, 2 Drawing Sheets

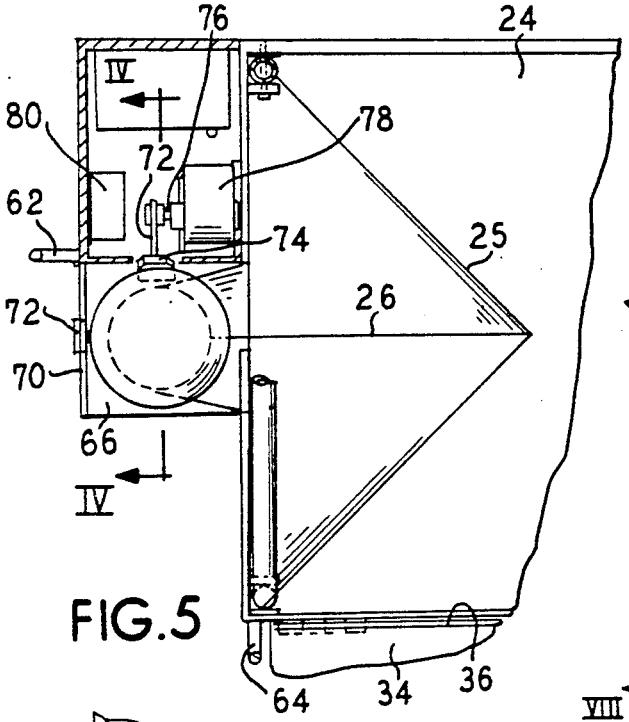
FIG.3
FIG.4
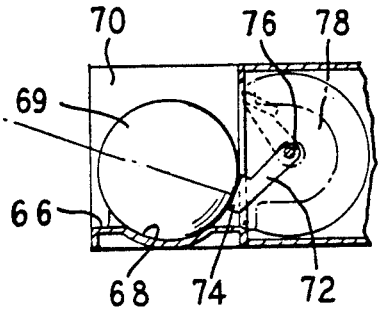
FIG.5
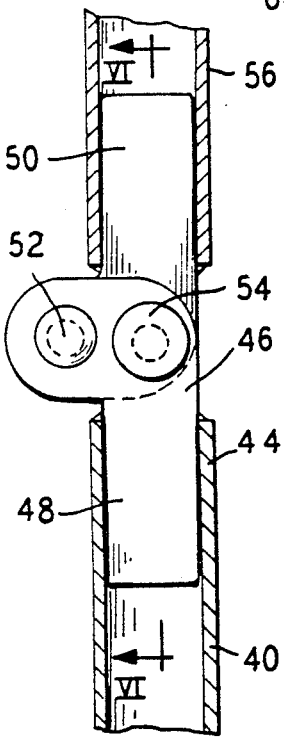
FIG.6
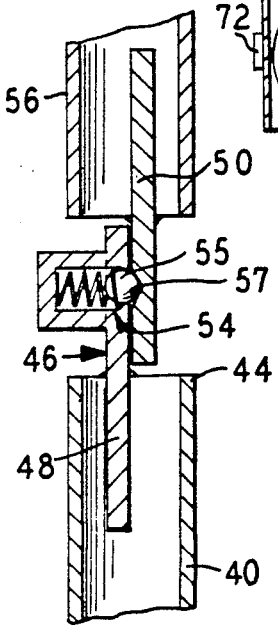
FIG.7
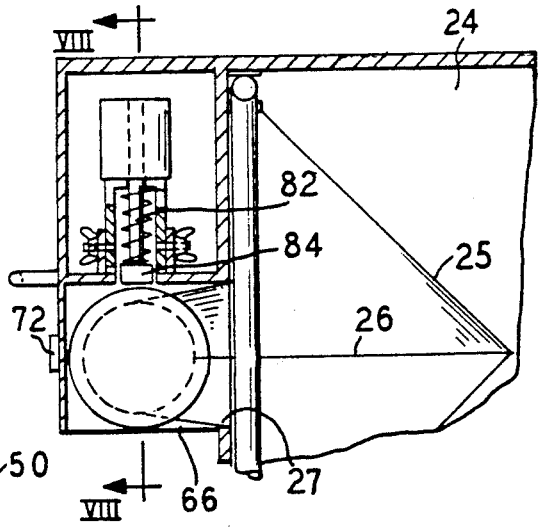
FIG 8
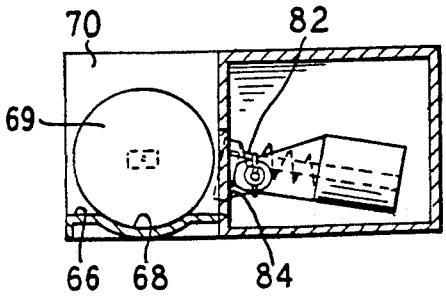

SOCCERBALL RETURNER

BACKGROUND OF THE INVENTION

1. Field of the Invention

The present invention relates to devices for returning a soccerball from a goal to a playing or practice area.

2. Description of the Prior Art

Devices are known for returning a soccerball from a goal to a playing area, such as those disclosed in U.S. Pat. Nos. 4,083,561; 4,286,786 and 4,615,528, but in each of those instances the return mechanism is a passive, ramp surface which causes the soccerball to return under the force of gravity. A serious shortcoming of these devices is that the return force on the ball is quite low due to the short length of the ramp surface as well as the low slope of the surface. Therefore, although the ball may be dispensed out of the goal area, since these goals are normally set up on a grass playing field, the distance that the ball would travel away from the goal would be quite limited because of the drag caused by the grass and uneveness of the playing field. Therefore, if a player wished to practice kicks at the goal from a distance of more than a couple of yards, he would be required to run up to the goal to retrieve the ball from the area in front of the goal and take it back to the area where the practicing is to occur. This results in inefficiencies in that a large amount of time and energy is expended in retrieving the ball from near the goal to take it to a point farther away.

Therefore, it would be an advantage if there were provided a device which would deliver a soccerball a greater distance from the goal than is possible by means of a passive ramp return device.

SUMMARY OF THE INVENTION

The present invention provides a device for delivering a soccerball from a goal area to a point up to thirty yards from the goal. This is accomplished by means of an active return device which may be in the form of a motor rotating a crank arm to kick the ball away from the goal or may be in the form of a spring loaded solenoid type plunger which would punch the ball away from the goal.

The goal itself includes a sloped floor which directs the ball to a plate located just outside of the goal where the ball is held awaiting the driving force which sends it away from the goal. A frame defines the goal opening, the frame being comprised of hinged tubular members which can collapse to result in a compact structure for easy transportation and storage. The structure is also provided with a pair of wheels to increase the mobility of the goal as it is being relocated.

The soccerball returner can also have a self-contained energy source such as a storage battery to operate the driving motor or solenoid.

BRIEF DESCRIPTION OF THE DRAWINGS

FIG. 3 is a partial sectional view taken generally along the line III—III of FIG. 2.

FIG. 4 is a side sectional view of a crank arm ball returner taken generally along the line IV—IV of FIG. 3.

FIG. 5 is a side view of a frame hinge.

FIG. 6 is a side sectional view of the frame hinge lock mechanism taken generally along the line VI—VI of FIG. 5.

FIG. 7 is a top sectional view of a solenoid operated return device.

FIG. 8 is a side sectional view taken generally along the line VIII—VIII of FIG. 7.

DESCRIPTION OF THE PREFERRED EMBODIMENTS

Figure 1:
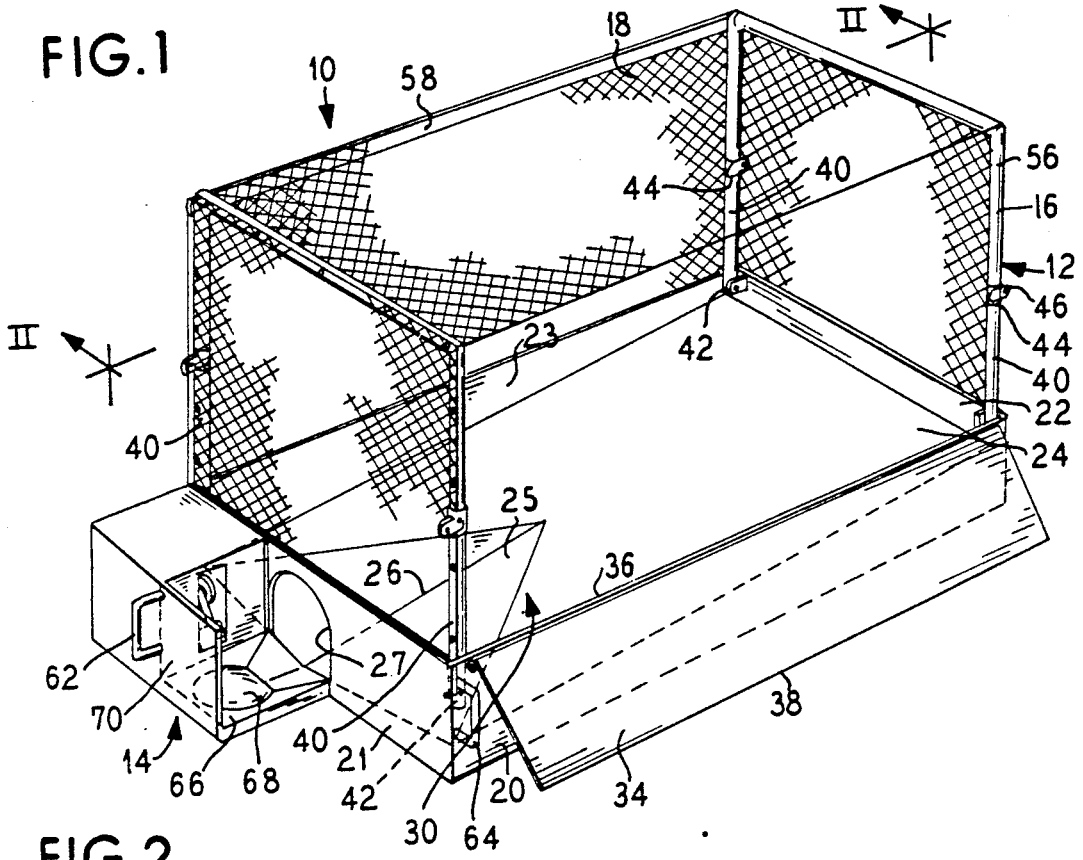
FIG. 1 is a perspective view of a soccerball returner embodying the principles of the present invention.

In FIG. 1 there is illustrated a soccerball returner generally at 10 which comprises a generally boxed shape goal member 12 and a ball return mechanism 14. The goal member 12 includes frame members 16 which support a netting 18 which form a top, rear and two sidewalls of the goal member. A lower panel enclosure is formed of separate front 20, side 21, 22 and rear 23 panels which are rigid, solid panels and which form a rigid frame for the goal member 12. A bottom wall or floor 24 of the goal member is formed of a solid ramped surface, as illustrated in the embodiment of FIG. 1 sloping downwardly from right to left and with a further sloped area 25 at the left hand side which is not only sloped right to left but also sloped toward a central line 26 leading to an opening 27 in the lower left sidewall 21 of the goal member 12.

A front 30 of the goal member is open above a lower wall 32 and a pivotable panel 34 is hinged along a long edge 36 to the lower front panel 20 so that an opposite long edge 38 may rest on the ground or other support surface for the ball returner to therefore provide a ramped surface leading toward the front opening 30 of the goal member.

The tubular frame 16 is comprised of four lower tube members 40, each one being positioned in a corner of the goal member 12 and having a bottom end 42 pivotally connected to a lower wall panel of the goal member 12. A top end 44 of each of the lower tube members 40 receives a hinge member 46 as is more clearly illustrated in FIGS. 5 and 6. The hinge 46 is formed of a lower leaf 48 and an upper leaf 50 pivotally connected at 52 and including a releasable lock means 54 which may be in a form of a spring loaded ball 55 carried by one of the leaves and being receivable in a detent 57 in the other of the leaves to lock the two leaves in a predetermined position and which would include means for releasing the ball from the detent to allow the leaves to be pivoted away from that predetermined position. Attached to the top leaf 50 is an upper tubular member 56 which may be in the form of a U-shaped tube such that one leg forms a top front vertical edge of the goal member and the other leg forms a top rear vertical edge of the goal member with the connecting portion forming a top side edge. A top rear horizontal edge may also be formed by a tubular member 58 which would be pivotally connected to an outside top rear corner of the two U-shaped upper tube members 56.

Figure 2:
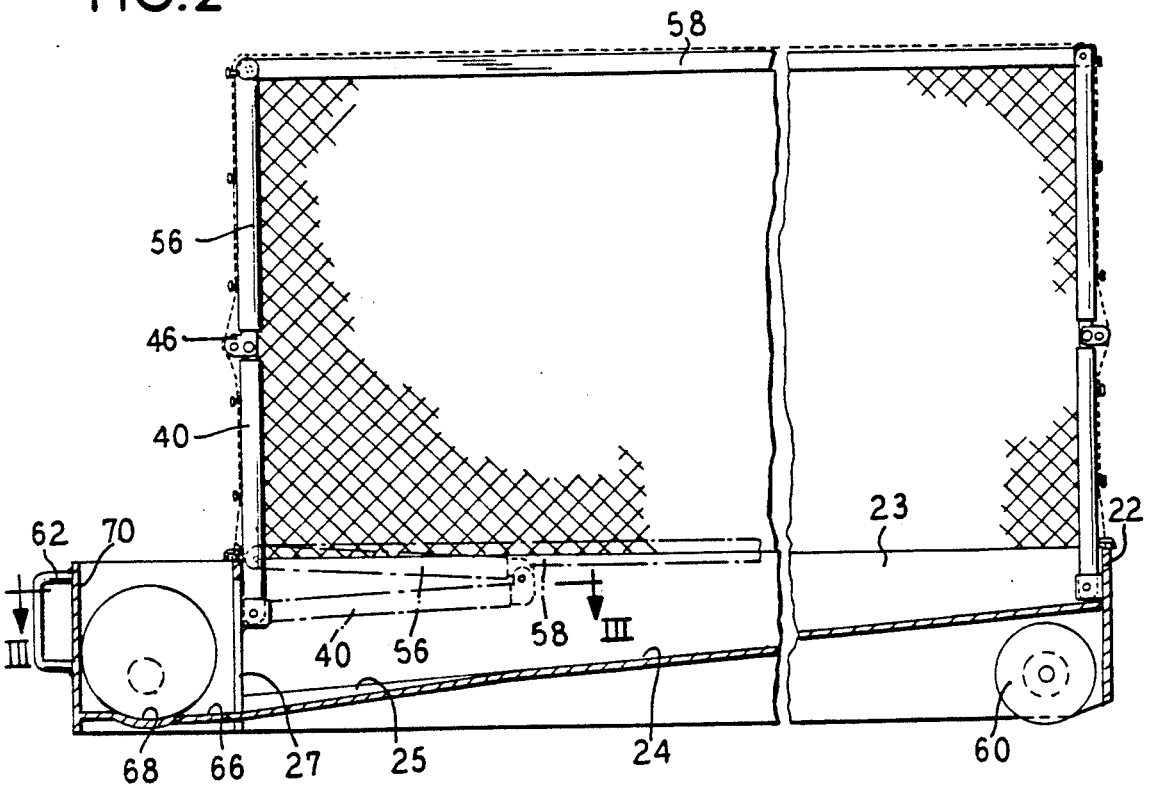
FIG. 2 is a sectional view of the soccerball returner taken generally along the line V—V of FIG. 1.

Due to the pivotal connection of the tubular members at the lower ends 42 of the lower tubes 40, at the hinges 46 between the upper tubes 56 and lower tubes 40 and between the upper rear tube 58 and the upper tubes 56, the goal member 12 can be collapsed to a compact height as illustrated in phantom in FIG. 2 such that the top of the goal member can be collapsed down to approximately the level of the lower wall panel portion to substantially reduce the volume of the goal member for transportation and storage purposes. This is accomplished simply by releasing each of the hinges from their locked position so that the hinge can pivot to the storage position. Assembly is quite easy by merely lifting up the top of the goal member causing the tubular members 40 and 56 to pivot into axial alignment whereupon the locking devices of the hinges will snap into place locking the entire frame into the useful position.

As seen in FIG. 2, beneath the right hand side of the floor 20 there is positioned a pair of wheels 60 (only one shown) which engage the ground or support surface and which permit the soccerball returner 10 to be easily transported from place to place by elevating the left hand side of the returner 10 and pulling or pushing the device on the wheels 60. A pair of handles 62, 64 are provided for assisting in the elevating of the left hand side.

As was mentioned above, the floor 20 of the goal member 12 is sloped downwardly from right to left and there is the separate sloped portion 22 which causes a ball captured within the goal to be directed toward the opening 26 in the lower left sidewall 28. Positioned just to the outside of the wall 28 is a receiving plate 66 which has a bowl-shaped depression 68 formed therein for receipt of a soccerball 69. A sidewall 70, to which the handle 62 is attached, is provided to prevent the soccerball from traveling beyond the capture point defined by the bowl-shaped depression 68. A switch 72 may be mounted in the sidewall 70 to sense the presence of the soccerball on the plate 66. When such a presence is sensed, an active ball return device can be activated to drive the ball forwardly away from the soccerball returner 10.

In the embodiment illustrated in FIGS. 1–4, the return mechanism is in the form of a crank arm 72 having a kick plate face 74 formed on an end thereof for engaging a rear portion of the ball as it is seated on the plate 66 to give it a forward and upward projectory as best seen in FIG. 4. An opposite end of the crank arm 72 is attached to a shaft 76 of a motor 78 which, when activated, causes the crank arm to rotate from an initial position shown in phantom in FIG. 4 through the position of contact shown in full lines in FIG. 4. For this purpose an appropriate motor would be selected which has a start-up speed and torque sufficient to provide enough force via the crank arm to drive the ball forwardly and upwardly a sufficient amount to cause the ball to come to rest approximately 30 yards from the soccerball returner 10. Different sized motors or crank arms could be utilized to provide a return force of a different amount to deliver the ball a different distance from the soccerball returner. An energy source 80, preferably in the form of a storage battery would supply the necessary power to operate the motor.

In the embodiment illustrated in FIGS. 7 and 8 the ball return mechanism is illustrated to be in the form of a spring loaded solenoid operated plunger 82 having a punch plate 84 which drivingly engages the soccerball at a rear side as is illustrated in FIG. 8 to give the ball a forward and upward trajectory. Again, the specific configuration of the solenoid and return spring would be selected to cause the ball to be driven up to 30 yards from the soccerball returner. Again, a storage battery could be utilized to provide the energy necessary to operate the solenoid.

The lower panel enclosure, particularly the front panel 20 provides a lip above the surface of the floor 24 which assures capturing of a soccerball which has been kicked into the goal and prevents the ball from rolling out the open front of the goal member. Once captured, the ball rolls down to the plate 66 from where it is driven away from the goal.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

I claim:

1. A soccerball returner comprising:

a goal member; and a return mechanism;

said goal member comprising a frame supporting a netting material to form top, rear and side walls while leaving a front area open;

one of said walls having an opening therethrough large enough to pass a soccerball; and a sloped floor to direct a soccerball captured within said goal member to and through said wall opening;

said frame comprising four vertical posts each pivotally mounted at a lower end and having a pivotal joint along its height such that said posts can be folded to permit said top to be moved toward said floor to provide a compact height during storage and transportation;

said return mechanism comprising a receiving plate onto which said soccerball is directed after passing through said wall opening; and a ball engaging element driven by a motive force to impart sufficient momentum to said ball to cause it to be driven away from said soccerball returner.

2. A soccerball returner according to claim 1, wherein said goal member further comprises a lower panel frame arrangement with frame panel elements forming a bottom portion of the rear, side and front walls.

3. A soccerball returner according to claim 2, wherein said wall opening is formed in one of said frame elements.

4. A soccerball returner according to claim 3, wherein said wall opening is formed in a frame element which forms a bottom portion of a side wall.

5. A soccerball returner according to claim 4, wherein said receiving plate is positioned on the outside of said lower panel frame arrangement directly opposite said wall opening.

6. A soccerball returner according to claim 2, wherein a frame panel forming the bottom portion of the front wall has a top edge which extends above said sloped floor.

7. A soccerball returner according to claim 6, wherein a ramp panel member is pivotally attached at a first side to said top edge of said front wall frame panel element and has a second, opposite side engageable with a supporting surface for said soccerball returner so that a ball rolling on said supporting surface toward said goal member will engage said ramp panel member and be directed to the interior of said goal member.

8. A soccerball returner according to claim 1, wherein said ball engaging element is a crank arm which is rotatably driven by an electric motor.

9. A soccerball returner according to claim 1, wherein said ball engaging element is a plunger member which is axially driven by a spring force selectively overcome by a solenoid.

10. A soccerball returner according to claim 1, wherein said return mechanism further comprises a switch means engagable by said soccerball when said soccerball is positioned on said receiving plate to activate said return mechanism.

11. A soccerball returner according to claim 1, wherein said goal member is provided with a pair of support surface engaging wheels at one end of the frame to assist in the transporting and relocating of said soccerball returner only when an opposite end of the frame is elevated.

12. A soccerball returner according to claim 1, wherein said pivotal joint on said vertical posts comprise locking hinges whereby the posts can be locked into an aligned position upon unfolding.

13. A soccerball returner comprising:

a goal member; and a return mechanism;

said goal member comprising a box-like structure having top, rear and sidewalls through which a soccerball is generally prevented from passing however one of said walls having an opening therethrough just large enough for said soccerball; and open front permitting passage of said soccerball into said goal member; and a sloped bottom wall which directs said soccerball toward and through said wall opening;

said sidewalls having a hinged joint along their height such that said sidewalls can be folded to permit said top to be moved toward said bottom wall to provide a compact height during storage and transportation; and said return mechanism comprising means for receiving and holding said soccerball in a fixed position after it has passed through said wall opening; and means for imparting sufficient momentum to said soccerball cause it to be driven away from said soccerball returner.

14. A soccerball returner according to claim 13, wherein said sloped floor is a rigid floor member.

15. A soccerball returner according to claim 13, including means for preventing a soccerball from rolling out of said front open side of said goal member.

16. A soccerball returner according to claim 13, wherein said hinged joints on said sidewalls comprise locking hinges whereby the sidewalls can be locked into a planar vertical position upon unfolding.

* * * * *